US005385109A

United States Patent [19]

Hrycin et al.

[11] Patent Number: 5,385,109

[45] Date of Patent: Jan. 31, 1995

[54] DISPENSER FOR DEPLOYING ELONGATED FLEXIBLE ARTICLES

[75] Inventors: Frank M. Hrycin, Fall River; David A. Abdow, Somerset, both of Mass.; John D. Babb, Bristol, R.I.

[73] Assignee: The United States of America as represented by the Secretary of the Navy, Washington, D.C.

[21] Appl. No.: 42,219

[22] Filed: Apr. 5, 1993

[51] Int. Cl.[6] ..... F41F 3/08

[52] U.S. Cl. ..... 114/238

[58] Field of Search ..... 114/238; 242/54 R, 55.2, 242/55.3, 55.53, 76, 77

[56] References Cited

U.S. PATENT DOCUMENTS 2,300,243 10/1942 Zierden .
2,911,996 11/1959 Kollmann .
3,508,644 4/1970 Martin .
4,523,538 6/1985 Hollmann et al. ..... 114/238
4,871,121 10/1989 Kodaka et al. ..... 242/54 R
4,974,789 12/1990 Milburn ..... 242/159

*Primary Examiner*—Stephen P. Avila
*Attorney, Agent, or Firm*—Michael J. McGowan; Prithvi C. Lall; Michael F. Oglo

[57] ABSTRACT

A dispenser for storing an elongated flexible article in a coil coaxially about a deployment axis. The dispenser includes a receptacle with a storage volume about the deployment axis. A partitioning structure in the storage volume includes circumferentially spaced sets of axially extending, deflectable fingers that define portions of storage channels for each turn in a coil. Flexible restraining bands attached to the receptacle overlie the storage volume to retain the turns axially within the storage channels. The structure prevents random turn positioning of individual turns of the coil. Deployment from the dispenser occurs without tangles, kinks or knots and proceeds smoothly and quietly.

30 Claims, 4 Drawing Sheets

DISPENSER FOR DEPLOYING ELONGATED FLEXIBLE ARTICLES

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

This invention generally relates to a dispenser for storing an elongated flexible article in coiled form and more specifically to a dispenser for facilitating the deployment of that article from storage.

(2) Description of the Prior Art

Dispensers for deploying elongated flexible articles from coiled storage contain a variety of articles including hoses, ropes, cables, electrical conductors and combinations of such articles and are useful in many diverse applications. The phrase "elongated flexible article" is meant to include any such article or combination.

These elongated flexible articles have a widely varying characteristics usually dictated by the nature of an application. In some, coiling produces internal bending stresses that tend to straighten the article unless the coil is restrained; other articles do not produce such internal bending stresses and stay in coiled form without restraint. Coiling may also produce internal torsional stresses in some articles. These stresses can cause the article to tangle, kink or knot as it deploys from a dispenser. Even where coiling does not introduce such internal stresses, deployment of the article may produce tangles, kinks or knots as a loose or overlying turn in the coil overlaps another.

In certain applications the dispenser must satisfy additional criteria. These criteria include a high level of deployment reliability and a smooth and quiet deployment. A smooth deployment occurs when the force required to deploy the article remains essentially constant. A quiet deployment occurs when the noise generated during deployment is insignificant in comparison to noises from other sources.

The following patents disclose dispensers for minimizing the possibility of tangles during deployment of some elongated flexible articles:

U.S. Pat. No. 2,300,243 (1942) Zierden
U.S. Pat. No. 2,911,996 (1959) Kollmann
U.S. Pat. No. 3,508,644 (1970) Martin
U.S. Pat. No. 4,871,121 (1989) Kodaka et al
U.S. Pat. No. 4,974,789 (1990) Milburn Zierden discloses a dispenser for an elongated flexible article in the form of a garden hose. Zierden's dispenser comprises a cup-shaped housing with a central hub that forms an open, annular storage volume for the hose. A cover, positioned under the housing during storage and deployment, allows the housing to rotate as the hose, that is relatively stiff axially, feeds into or from the housing. The cover closes the opening for storage purposes.

The Kollmann patent discloses a dispenser for a garden hose having the form of a partially closed basket that encompasses the circumference of a coiled hose. The dispenser relies on the natural tendency of the garden hose to straighten itself thereby to displace the hose outwardly against the basket.

In dispensers of the type shown in the Zierden and Kollmann patents, individual turns of the hose can be located at random positions in the coil. This random turn positioning can occur during winding and during storage if the dispenser is subject to movement or shock. During deployment, particularly along a horizontal axis, one turn may slide or slip over another to produce random turn positioning. Whenever random positioning occurs, deployment is likely to produce unwanted tangles, kinks or knots in the deployed article.

The Martin patent discloses a stowage device for a cable stored as a single layer coil that is coaxial with an axis along which cable deployment occurs. The cable connects between an aircraft ejection seat and a sear for firing a rocket pack attached to the seat. This stowage apparatus comprises a plate with a spiral channel that receives the cable and radially extending frangible retaining strips to lock the cable into the spiral channel and prevent inadvertent movement and entanglement. As the cable deploys from successive turns, it fractures the frangible strips in succession to provide an orderly deployment without tangles, kinks or knots.

The Kodaka et al and Milburn patents disclose structures for retaining relatively stiff fiber optic cables in a coiled form for deployment. Kodaka et al specifically disclose open-ended annular cable tanks. Milburn et al discloses a structure with first and second chambers separated by a divider. This is a completely enclosed structure in which the fiber optic cable is apparently wound in two single layer coils separated by the divider.

Dispensers of the type shown in the Martin and Milburn patents provide structures that store a flexible elongated article in a coil that can be coaxial with a horizontal deployment axis. However, breaking of the frangible devices in the Martin structure in succession produces uneven tension forces on the cable during deployment, so the deployment is not smooth. The movement of the various elements of the Milburn patent can produce unacceptable noise levels. Dispensers of the type shown in the Zierden, Kollmann and Kodaka patents store articles that are relatively stiff so internal forces cause the individual turns radially outward against a cylindrical wall or retaining structure. If it is desired to store and deploy an elongated flexible article that does not produce such stresses, the foregoing dispensers may not be useful, particularly if the deployment axis is horizontal. Under such circumstances deployment of one turn could displace another turn into a random position with the potential for tangles, kinks or knots.

The following patents disclose dispensers for storing articles in a coiled form with components for reducing noise during use:

U.S. Pat. No. 4,874,138 (1989 ) Kettearing
U.S. Pat. No. 4,925,122 (1990 ) Bannai The Kettearing patent discloses an elongated flexible article, in the form of a signal cable, between concentric devices that can undergo limited relative rotation. The signal cable lies in a spiral between support bands with protective bands that follow the shape of a spiral thereby to space the structure from the relatively rotating portions. The Bannai patent discloses a structure for a similar application in which flexible fingers expand radially outward and inward on the inside and outside respectively of a coiled flat cable thereby to space the cable from the surrounding storage structure for the purpose of reliability and noise reduction. Neither of these patents disclose a dispenser for storing and deploying the stored elongated flexible article.

Although this invention can be used in a variety of applications, it is particularly adapted for storing and deploying an elongated flexible article in the form of a flexible hose containing a communication cable that deploys when a submarine launches a torpedo. In this application a dispenser assembly mounts to the rear of the torpedo for storage by means of a quick release mechanism. The torpedo is loaded into the torpedo tube with the dispenser assembly attached. The dispenser is then released from the torpedo and locked into the torpedo tube by adjustable side locks. When the torpedo is fired, it pulls the flexible hose from the dispenser. The flexible hose releases from the torpedo after the flexible hose is fully dispensed.

The general use of dispensers in this application are disclosed in the following patents:

U.S. Pat. No. 3,158,124 (1964) Chevillon

U.S. Pat. No. 4,523,538 (1985) Hollmann et al

The Chevillon patent discloses a torpedo that is launched from horizontal launching rails. A dispenser moves axially along the rails until the torpedo leaves the launching apparatus whereupon the launching apparatus restrains the dispenser and allows a communication cable, as an elongated flexible article, to deploy from the dispenser with the torpedo. The Hollmann patent discloses a launching apparatus which discloses the use of a dispenser attached to the aft end of a torpedo. When the torpedo is launched, it detaches from the dispenser and deploys the communication cable. Neither patent discloses the details of the dispenser construction.

Conventional dispensers for such communication cables include a central hub and a concentric cylindrical wall and transverse radially extending base that form an open-ended annular storage volume for storing a flexible, cable-containing hose in a multiple-turn, multiple-layer coil. Restraining bands, in the form of elastic O-rings or the like, traverse the storage volume proximate the open end to capture the turns in the storage volume. During deployment, the flexible hose is led from the storage area between the hub and restraining bands. As the hose deploys with a torpedo, the hose stretches the elastic restraining means to allow individual turns to be withdrawn from their respective wraps. This dispenser provides a smooth and quiet deployment. However, the coiled cable is subject to tangling, knotting or kinking because the individual coil turns are subject to random turn positioning while the flexible hole is coiled, during storage and handling and during deployment.

In an alternative, the dispenser includes a metal partition in the storage volume to define nearly continuous concentric channels throughout the storage volume. The partitions are cylindrical in form, but are spaced at one location to form a transition area that allows the flexible hose to transfer between adjacent channels. In addition, the partitions extend axially through the entire coil, so they form continuous deep channels for receiving the flexible hose to produce multiple-turn, multiple-layer coils in which corresponding turns across adjacent layers are aligned and separated from adjacent turns. Dimpled portions in the partitions proximate each free end of a partition partially close each channel. As the flexible hose deploys, the dimpled portion and/or flexible hose deforms to release the flexible hose from the channel. However, the partitions do not easily deflect radially. As a result the force deploying the flexible hose varies greatly and produces tension spikes as the flexible hose pulls past each dimpled portion. Moreover, deployment produces a pattern of audible clicking noises. Consequently while this structure prevents individual turns from positioning, it does not deploy a flexible hose smoothly or quietly.

SUMMARY OF THE INVENTION

Therefore it is an object of this invention to provide a dispenser that enables an elongated flexible article to deploy quietly, free of tangles, knots and kinks.

Another object of this invention is to provide a dispenser that allows a coiled elongated flexible article to deploy smoothly, free of tangle, knots and kinks.

Still another object of this invention is to provide a dispenser that stores an elongated flexible article in a coiled form that eliminates individual turns from random positioning and yet enables a minimal force to deploy the article.

Yet still another object of this invention is to provide a dispenser that stores an elongated flexible article in a coiled form that eliminates individual turns from random positioning and yet enables a minimal force to deploy the article quietly and smoothly.

In accordance with this invention, a dispenser includes an open-ended receptacle for storing the article in a storage volume formed about a deployment axis. A partition that attaches to the receptacle and includes a set of radially deflectable, axially extending and transversely spaced fingers, defines a portion of a set of channels for receiving individual turns of an elongated flexible article. A flexible restraining structure also attaches to the receptacle and traverses the storage volume to enable the article to deploy while retaining any remaining article turns within their respective channels.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF THE PREFERRED EMBODIMENT

Figure 1:
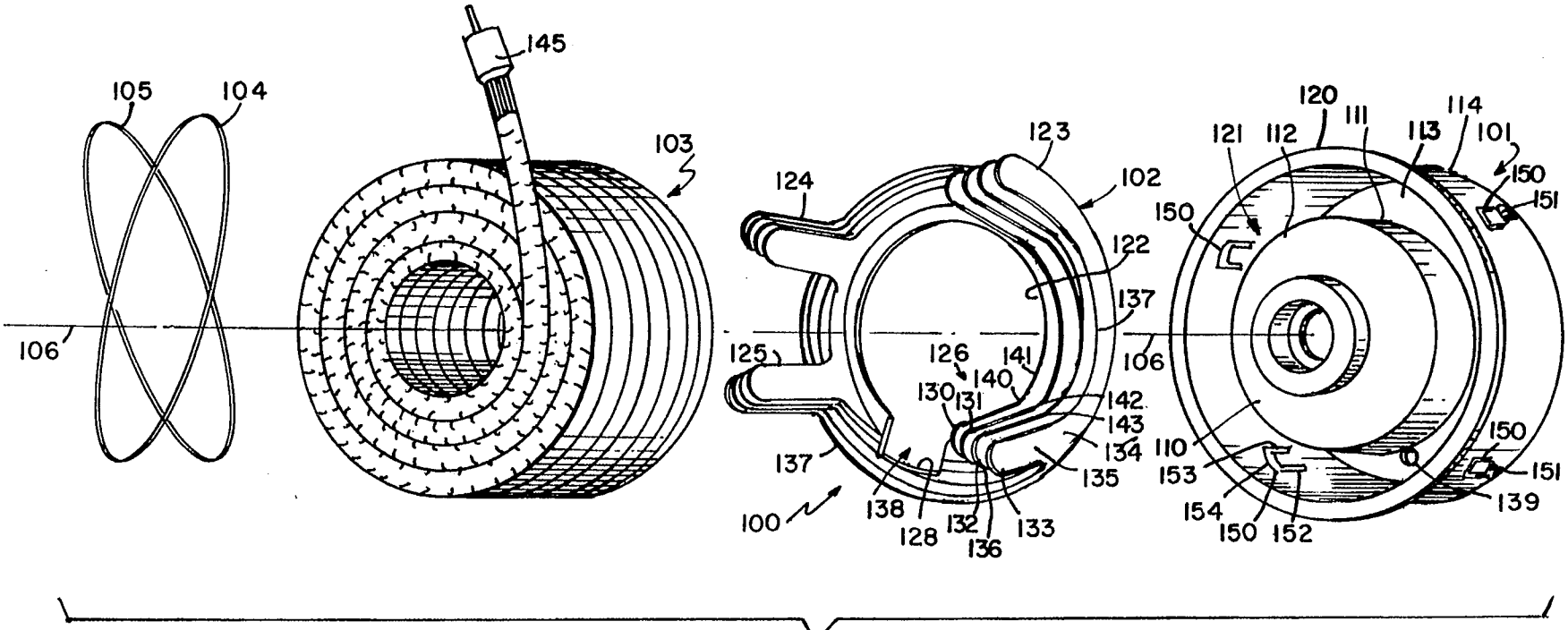
FIG. 1 is an exploded perspective view of a dispenser assembly constructed in accordance with this invention for storing and deploying an elongated flexible article.
Figure 2:
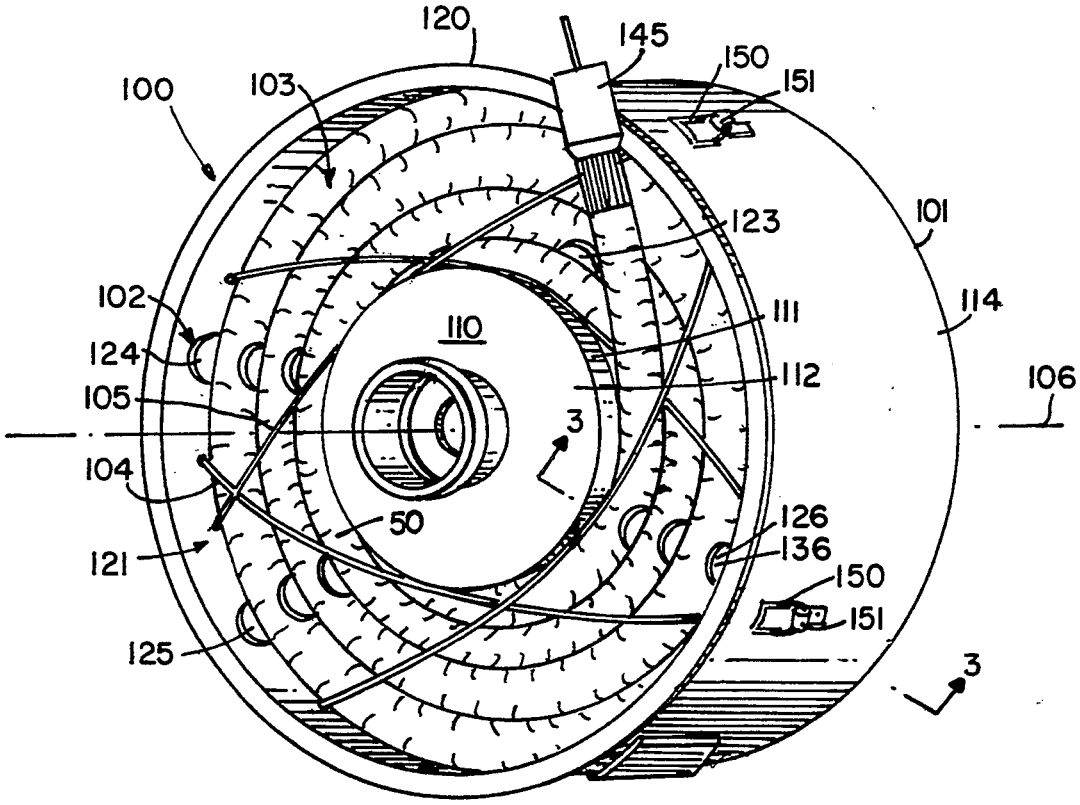
FIG. 2 is a perspective view of the dispenser in FIG. 1 in assembled form.

In accordance with this invention a dispenser 100, shown in FIGS. 1 through 4, includes a receptacle 101, and a partitioning insert 102 for storing an elongated flexible article, such as a flexible hose 103 with an internal conductor or conductors, as a multiple-turn, multiple-layer coil. Restraining bands 104 and 105 complete the dispenser 100. As shown in FIGS. 1 and 2 these components mount together coaxially about a deployment axis 106 that is generally horizontal in a submarine application.

Referring particularly to FIG. 1, the receptacle 101 in a preferred form, includes a cylindrical hub 110 that contains, within a cylindrical wall 111 and an end wall 112, various mounting hardware for connection to a torpedo and submarine launch tube and other ancillary equipment. These components are known in the art and are not important to an understanding of this invention, so no details of these components are shown.

A base plate 113 extends radially from one end of the hub 110 to support a cylindrical shell 114 that is concentric with and spaced from the cylindrical wall 111. As shown particularly in FIGS. 3 and 4, the base plate 113 can comprise a stamped annular structure with a radially extending plate 115 and axially extending parallel lips 116 and 117 forming annular tabs. The lip 116 attaches to the cylindrical wall 111 by welding or other means and thereby provides a radially extending annular base. The cylindrical shell 114 then attaches to the lip 117 to be supported concentrically with the cylindrical hub 110. The end of the cylindrical shell 114 distally located with respect to the base 113 comprises a rolled edge 120. This structure defines an annular storage volume 121 coaxially with the deployment axis.

The partitioning insert 102 is molded or cast with an annular base 122 that attaches or abuts the base plate 113. Sets of radially spaced fingers extend from the base 122. Each set is spaced circumferentially about the annular base. As shown in the specific embodiment of FIG. 1, the partitioning insert 102 includes four finger sets 123, 124, 125 and 126. Sets 123 and 125 are positioned approximately diametrically oppositely of the base 122. Finger sets 124 and 126 lie intermediate sets 123 and 125. The positioning of these finger sets is described later. The base has a notch formed intermediate the finger sets 125 and 126.

In this particular embodiment each finger set comprises four individual radially spaced fingers. The finger set 126, for example, includes a radially inner finger 130, two radially spaced intermediate fingers 131 and 132 and an outer finger 133. Each of the fingers, such as the finger 133, has a base portion 134 and an intermediate portion 135 that extends axially to a free end 136.

In accordance with a preferred embodiment of this invention, the partitioning insert 102 defines essentially continuous concentric channels proximate the base plate 113 for facilitating the initial coiling operations and providing structural rigidity. As shown in FIG. 1, an arcuate extension 137 extends between the base portion 134 of finger 133 and the base portion of a corresponding radially outer finger in set 123. The extension 137 is axially coextensive with a portion of the finger 133. Collectively these extensions form continuous concentric channels between certain pairs of finger sets, as between sets 123 and 124, sets 124 and 125 and sets 126 and 123.

There are no extensions between finger sets 123 and 126. This area constitutes a transition area 138 in which the flexible hose 103 can transfer smoothly between adjacent channels thereby to produce a multi-turn layer and multiple layers. In addition the notch 128 and an opening 139 in the base plate 113 permit the other end of the flexible hose 103 to be led outside the dispenser 100 for connection to equipment in the submarine.

The circumferentially spaced sets of fingers effectively define a series of concentric channels even though the fingers only extend along portions of the channels. In the specific embodiment of FIGS. 1 through 4, the four fingers in each set, such as fingers 130 through 133 in set 126, the cylindrical wall 111 and the cylindrical shell 114 form, as shown in FIGS. 3 and 4, five concentric channels 140 through 144 each having a width that accommodates one turn of the flexible hose 103.

Figure 3:
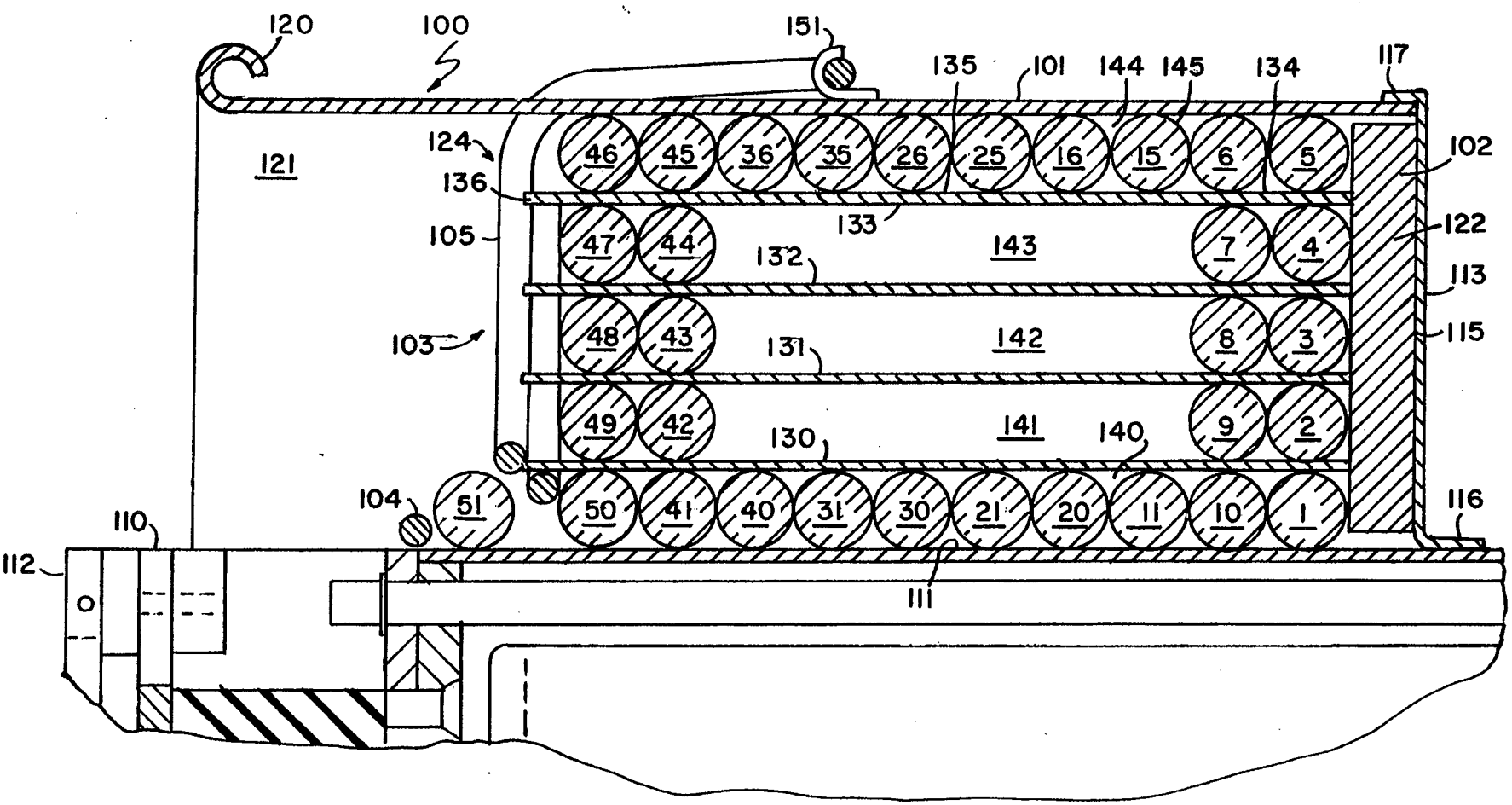
FIG. 3 is a cross-section along lines 3—3 of FIG. 2 for depicting a preferred arrangement of coil turns prior to deployment.
Figure 4:
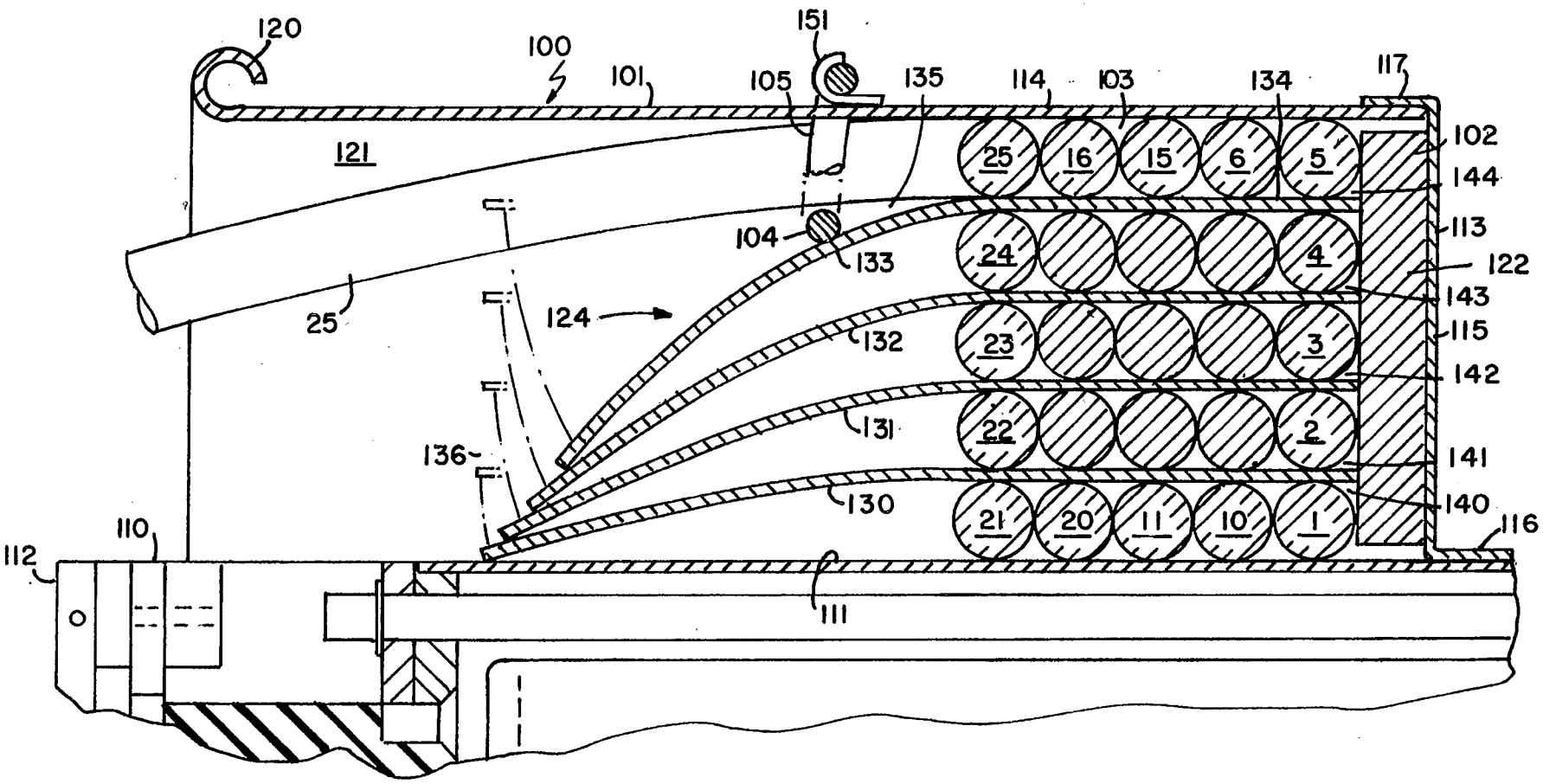
FIG. 4 is a cross-sectional view similar to the view in FIG. 3 showing the dispenser after partial deployment of an elongated flexible article.

Referring now to FIGS. 1 and 3, the flexible hose 103 is stored in the annular storage volume 121 in an ordered sequence shown by reference numerals 1 through 50 in FIG. 3. The first turn lies in the channel 140 between the cylindrical wall 111 and the finger 130. As the hose 103 completes a revolution around the channel 140 as shown in FIG. 1, it skews radially outward in the transition area 138 to enter the channel 141 for the next turn. Successive turns continue until turn 5 is laid in channel 144. Turn 6 starts a new layer in channel 144. This second layer is completed by winding the hose in the individual channels 143 to 140 in succession. Coiling continues as shown in FIG. 3 until producing turns 7 through 10. The hose 103 is coiled in the individual channels in the ordered sequence. Consequently, the partitioning insert 102 prevents random turn positioning during the coiling operation.

As will be apparent from FIGS. 1 through 3, each of the fingers 130 through 133 extends axially past all the layers (i.e., beyond turns 46 through 50 in FIG. 3) so the tips or free ends of the fingers, such as free end 136, are visible when the dispenser is full.

In FIG. 3 the coil turn 51 represents the free end of the hose 103. It extends adjacent the hub 110 and radially inside the restraining bands 104 and 105 to an end connector 145, shown in FIGS. 1 and 2, that connects to the torpedo or similar object to be displaced along the deployment axis 106.

Once the flexible hose 103 is fully coiled, the restraining bands 104 and 105 attach over the end of the coiled hose 103 to the shell 114. Specifically, the shell 114 contains approximately diametrically opposite notches 150 formed through the wall and an external hook 151 proximate each of four positions of the finger sets 123 through 126. The U-shaped notches include spaced, parallel axially extending legs 152 and 153 and a cross slot 154. The hook 151 attaches to the exterior surface of the shell 114 proximate the ends of the leg slots 152 and 153. The specific positioning of each notch 150 and hook 151 is determined by other hardware mounted on the shell 114. Generally, however, each set of fingers is placed such that the radial centerline of the fingers are centered between the corresponding restraining bands. The finger set 126, however may not be diametrically opposite the finger set 124 because it oftentimes must be offset angularly to the side (the right side in FIG. 1) of the notch 128.

For example, the restraining band 104, in the form of an O-ring, is fed through the notches 150 proximate finger sets 123 and 125 and around the corresponding hooks 151. This places the restraining band 104 in tension with intermediate portions of the band 104 being spread to lie against the cylindrical wall 111 of the hub 110. Similarly the restraining band 105 passes through the notches 150 at positions corresponding to the finger sets 124 and 126 thereby to lie at approximately right angles to the band 104.

The end of the flexible hose is fed through the portion of both restraining bands 104 and 105 that lie against the cylindrical wall 111 as shown in FIG. 2. This positioning allows the restraining bands 104 and 105 to restrain the flexible hose 103 while it dispenses. When the flexible hose 103 is stored thusly in the dispenser 100, as shown in FIG. 2, the restraining bands 104 and 105 prevent individual turns in the coil 103 from falling from the dispenser 100 especially when the dispenser 100 is on a horizontal axis 106. Consequently the partitioning insert 102 prevents random turn positioning during storage.

As deployment begins, the end connector 145 moves along the deployment axis 106 away from the dispenser assembly 100. As the first turn, namely turn 50 in FIGS. 2 and 3 deploys, the flexible hose 103 bends to run essentially along the axis 106 and forms a departure point or lift point with respect to the remaining turns in the storage volume 121. As deployment continues, the departure or lift point travels around storage volume 121. When the departure point engages one of the restraining bands 104 or 105, that band stretches radially to allow the payout to continue while still retaining the remaining turns axially. Thus the restraining bands 104 and 105 and the finger sets 123 through 126 act to prevent turns from falling from the individual channels prematurely so random turn positioning does not occur during deployment. As successive turns are removed, the departure point continues to rotate around the hub 110, but at different radii corresponding to the radius of each turn being removed from a layer. Thus as the hose 103 at the turn 46 in FIG. 3 deploys, the band 104 stretches radially nearly to the shell 114.

In accordance with a preferred form of this invention, the partitioning insert 102 is cast from a deformable material that is compatible with the environment, that is highly resistant to wear, that is durable and that has a low coefficient of friction with respect to the elongated flexible article stored within the insert. For purposes of the particular application, the partitioning insert 102 can be cast from an elastomer such as a Gallagher Corporation Polyurethane Elastomer GC-1575 Durometer D70-75. Other materials can also be used. Environmental compatibility and durability allow the reuse of the insert. The low coefficient of friction provides two benefits. First, the force required to deploy the hose 103 becomes essentially the force required to expand the restraining bands 104 and 105 as sliding friction that may exist between the flexible hose 103 and the individual fingers is insignificant. Furthermore the reduction of friction reduces the potential for generating noise.

The flexible nature of the material provides another advantage. As the successive turns are removed from the annular storage volume 121, for example, to the point where turn 31 shown in FIG. 3 is removed, the restraining bands 104 and 105 fall between the adjacent fingers and form a straight line from the bottom of the notches 150 in a plane normal to the axis 106. Moreover, at some point during the deployment, the restraining band 104 will stretch to a point adjacent the outer cylindrical shell 114. When the departure point passes a set of fingers, for example the set 126 in FIG. 4, the band 104 will remain captured in the outer channel 144 by the finger 133.

When this occurs, the restraining band 151 compresses the finger 133 radially inward such that the tip 136 and remaining tips of each finger contact the adjacent finger and bend all the fingers together radially inward. As a result the fingers close their respective channels and wedge the remaining turns in place. This prevents any axial shifting.

As the departure point again moves to deploy hose 103 from another channel, such as channel 143, shown in FIG. 4, the deployment causes the finger 133 to move radially outward thereby to open the channel and to allow the hose to deploy freely. The force required to produce this deflection is essentially the same force as required to deflect the bands 104 and 105. Consequently, the deployment force remains essentially constant.

Although the opening and closing may produce successive contacts between the free ends of adjacent fingers, any noise generated by those contacts is insignificant because elastomeric materials do not produce significant levels of noise when they are struck.

Therefore in accordance with this invention a dispenser for an elongated flexible article stores the article in a coil form coaxially with a deployment axis in an ordered form that prevents random turn positioning. This force required to deploy the hose is deformed by the tension forces that stretch the elastic restraining bands 104 and 105. Consequently the deployment force is relatively constant so deployment is smooth. The use of flexible elastomeric fingers further contributes to the low force by minimizing the area of sliding friction. This also contributes to noise reduction. Elastomeric materials are also characterized by good reliability even where they are repeatedly deformed, so the resulting structure is also highly reliable and durable.

FIGS. 1 through 4 disclose a particular embodiment of a dispenser for use in deploying a torpedo flexible hose and communication cable during a launching operation. The flexible hose 103 is wrapped in a counter clockwise direction in dispenser 101 as shown in FIG. 3. The dispenser 101 is rotated while the flexible hose 103 is being wrapped. During deployment of the flexible hose it is necessary for the hose to absorb these torsional forces. If the hose is unable to absorb these forces one or more swivels can be added to the hose to allow the hose to rotate once after each successive turn is deployed from dispenser 101. In addition the hose could be wrapped with a pretwist condition that will cancel out the incurred twist on the hose it deployed. Alternatively one might mount the dispenser for rotation about the deployment axis 106. Dispenser rotation would relieve any torsion forces that might otherwise buildup. As will also be apparent, the particular winding sequences shown in FIG. 3 can be altered. The number of sets of fingers and the angular spacing between adjacent sets can vary. Other restraining means may capture the turns axially within the insert, but expand radially to facilitate the deployment of the article.

Although this invention has been disclosed in terms of certain embodiments, it will be apparent that the foregoing and other modifications can be made to the disclosed apparatus without departing from the invention. Therefore, it is the intent of the appended claims to cover all such variations and modifications as come within the true spirit and scope of this invention.

What is claimed is:

1. A dispenser for deploying an elongated, flexible article generally along a deployment axis, said dispenser comprising:

open-ended receptacle means for storing the article in a multiple-turn, multiple-layer configuration about the deployment axis in a storage volume;

partitioning means in said storage volume for defining portions of individual channels for containing individual article turns, said partitioning means including a plurality of sets of radially deflectable, axially extending, transversely and circumferentially spaced fingers that are radially spaced by a distance determined by the article; and flexible restraining means attached to said receptacle means and traversing said storage volume for enabling the article to deploy from, while retaining remaining article turns within their respective channels.

2. A dispenser as recited in claim 1 wherein said partitioning means comprises a plurality of sets of fingers, each said set being spaced about the volume for defining at spaced locations, multiple portions of said individual channels.

3. A dispenser as recited in claim 2 wherein said partitioning means additionally comprises a base for supporting said fingers.

4. A dispenser as recited in claim 3 wherein each of said fingers comprises a base portion attached to said base, an intermediate portion extending axially from said base portion and terminating at a free end thereof, each said finger extending axially past all layers of a coil in said storage volume.

5. A dispenser as recited in claim 4 wherein said partitioning means additionally comprises extensions of said base portions between certain of adjacent ones of said fingers that lie along the location of the channel between adjacent sets of fingers and that are axially coextensive with only a portion of said fingers.

6. A dispenser as recited,in claim 5 wherein said extensions terminate at one location about a channel for forming a transition area thereby enabling the article to pass between adjacent channels to form adjacent turns of the article and allow one end of said flexible article to exit from said dispenser.

7. A dispenser as recited in claim 3 wherein said restraining means includes first and second elastic means independently attached to said receptacle along axes transverse to the deployment axis and angularly displaced with respect to each other.

8. A dispenser as recited in claim 7 wherein each of said first and second elastic means comprises a continuous elastic cord in a loop and said receptacle means includes means for attaching said cord at multiple locations on said receptacle means.

9. A dispenser for storing flexible hose means in a coil about a deployment axis, said dispenser comprising:

annular receptacle means for forming an open-ended annular storage volume coaxially with the deployment axis;

partitioning means located in said annular storage volume including a plurality of sets of radially deflectable, axially-extending fingers that are radially spaced by a distance determined by the flexible hose means, each said set being circumferentially spaced from the others of said sets, said fingers defining portions of concentric, axially extending storage channels in which plural layers of the hose means are disposable in said storage volume; and flexible restraining means attached to said receptacle means and traversing said storage volume for enabling the flexible hose means to deploy from said channels in said storage volume while retaining remaining flexible hose means turns within said channels.

10. A dispenser as recited in claim 9 wherein said annular receptacle means includes a cylindrical hub portion, an annular base portion extending radially from said hub portion and a cylindrical shell portion attached to said base portion concentrically with said hub portion thereby to form the annular storage volume, said shell portion including means positioned a fixed distance from said base portion for attaching to said flexible restraining means.

11. A dispenser as recited in claim 10 wherein said attachment means comprises engaging means mounted to the exterior of said shell portion for engaging said restraint means and slot means through said shell portion proximate said engaging means for passing said restraining means to said engaging means.

12. A dispenser as recited in claim 10 wherein said partitioning means includes an annular base means mounted at said receptacle base portion for supporting said sets of axially extending fingers.

13. A dispenser as recited in claim 12 wherein each of a pair of said sets of fingers is approximately diametrically opposed in said storage volume.

14. A dispenser as recited in claim 13 wherein said engaging means attached to said shell portion at approximately diametrically opposed positions, a diameter through said attachment means being angularly displaced with respect to a diameter through said opposed sets of fingers, said restraint means being expanded radially during deployment of the flexible hose means and continuously applying a force for retaining remaining flexible hose turns in said channels.

15. A dispenser as recited in claim 13 wherein said engaging means attached to said shell portion at diametrically opposed positions, a diameter through said attachment means being angularly displaced with respect to a diameter through said opposed sets of fingers, said restraint means being expanded radially during deployment of the flexible hose means and continuously applying a force for retaining remaining flexible hose turns in said channels and, after a number of turns have been deployed from said storage volume, for enabling said fingers to capture said restraint means in a said channel, said restraint means thereafter deflecting said finger means between said restraint means and said hub radially toward said hub portion to close those channels defined by said deflected fingers.

16. A dispenser as recited in claim 12 wherein said partitioning means include first, second, third and fourth sets of fingers, said first and third finger sets lying approximately on a first diametric line and said second and fourth finger sets lying approximately on a second diametric line angularly displaced from the first diametric line, said receptacle including first, second, third and fourth attachment means positioned on the shell portion a predetermined distance from said base plate at the intersections of the finger set diameters.

17. A dispenser as recited in claim 16 wherein said restraint means comprise first and second continuous elastic loop means for attachment to corresponding attachment means on the first or second diameters, each said loop means stretching passed the turns of the flexible hose means in said partition means.

18. A dispenser as recited in claim 16 wherein said restraint means comprise first and second continuous elastic loop means for attachment to corresponding attachment means on the first or second diameters, each said loop means stretching passed the turns of the flexible hose means in said partition means and, after a predetermined number of turns are deployed from said storage volume, for enabling said fingers to capture said loop means in a said channel, said loop means thereafter deflecting each said finger between said loop means and said hub portion radially toward said hub portion to close the channels defined by said deflected fingers.

19. A dispenser as recited in claim 13 wherein each of said fingers has a base portion attached to said base, an intermediate portion extending axially from said base portion and terminating at free end thereof, each said finger extending axially past all layers of a coil in said storage volume and said partitioning means additionally includes arcuate extensions between certain of said finger base portions that are axially coextensive with only a portion of said fingers for forming, intermediate certain of said finger sets, continuous channels, said extensions being spaced between two of said finger sets for enabling the flexible hose means to pass between adjacent channels to form adjacent turns of the coil.

20. In a torpedo launching system including torpedo means for moving initially along an axis, launching means for propelling the torpedo means along the axis and flexible hose means for deployment with the torpedo means thereby including means for maintaining electrical contact between the torpedo means and the launching means for a predetermined interval after launch, the improvement of dispensing means for storing and deploying said flexible hose means reliably, smoothly and quietly comprising:

annular receptacle means attached to the launching means for forming an annular storage space that is coaxial with the axis;

elastomeric partitioning means located in said annular storage space including a plurality of sets of axially-extending fingers being radially spaced by a distance corresponding to the size of the flexible hose means, each said set being circumferentially spaced from the others of said sets and each of said fingers being formed of a material for enabling said finger to deform radially; and flexible restraining means attached to said receptacle means and traversing said storage volume for enabling the flexible hose means to deploy from said storage volume smoothly, reliably and quietly while retaining remaining flexible hose means turns within said storage volume.

21. A dispenser for use in a torpedo launching system as recited in claim 20 wherein said annular receptacle means includes a cylindrical hub portion, an annular base portion extending radially from said hub portion and a cylindrical shell portion attached to said base portion concentrically with said hub portion thereby to form the annular storage volume, said shell portion including means positioned a fixed distance from said base portion for attaching to said flexible restraining means.

22. A dispenser for use in a torpedo launching system as recited in claim 20 wherein said attachment means comprises engaging means mounted to the exterior of said shell portion for engaging said restraint means and slot means through said shell portion proximate said engaging means for passing said restraining means to said engaging means.

23. A dispenser for use in a torpedo launching system as recited in claim 21 wherein said partitioning means includes an annular base means mounted at said receptacle base portion for supporting said sets of axially extending fingers.

24. A dispenser for use in a torpedo launching system as recited in claim 23 wherein each of a pair of said sets of fingers is approximately diametrically opposed in said storage volume.

25. A dispenser for use in a torpedo launching system as recited in claim 24 wherein said engaging means attached to said shell portion approximately diametrically opposed positions, a diameter through said attachment means being angularly displaced with respect to a diameter through said opposed sets of fingers, said restraint means being expanded radially during deployment of the flexible hose means and continuously applying a force for retaining remaining flexible hose means turns in said channels.

26. A dispenser for use in a torpedo launching system as recited in claim 24 wherein said engaging means attached to said shell portion at approximately diametrically opposed positions, a diameter through said attachment means being angularly displaced with respect to a diameter through said opposed sets of fingers, said restraint means being expanded radially during deployment of the flexible hose means and continuously applying a force for retaining remaining flexible hose means turns in said channels and, after a number of turns have been deployed from said storage volume, for enabling said fingers to capture said restraint means in a said channel, said restraint means thereafter deflecting said finger means between said restraint means and said hub radially toward said hub portion to close those channels defined by said deflected fingers.

27. A dispenser for use in a torpedo launching system as recited in claim 24 wherein said partitioning means include first, second, third and fourth sets of fingers, said first and third finger sets lying on a first diametric line and said second and fourth finger sets lying on a second diametric line angularly displaced from the first diametric line, said receptacle including first, second, third and fourth attachment means positioned on the shell portion a predetermined distance from said base plate at the intersections of the finger set diameters.

28. A dispenser for use in a torpedo launching system as recited in claim 27 wherein said restraint means comprise first and second continuous elastic loop means for attachment to corresponding attachment means on the first or second diameters, each said loop means stretching passed the turns of the flexible hose means in said partition means.

29. A dispenser for use in a torpedo launching system as recited in claim 27 wherein said restraint means comprise first and second continuous elastic loop means for attachment to corresponding attachment means on the first or second diameters, each said loop means stretching passed the turns of the flexible hose means in said partition means and, after a predetermined number of turns are deployed from said storage volume, for enabling said fingers to capture said loop means in a said channel, said loop means thereafter deflecting each said finger between said loop means and said hub portion radially toward said hub portion to close the channels defined by said deflected fingers.

30. A dispenser for use in a torpedo launching system as recited in claim 27 wherein each of said fingers has a base portion attached to said base, an intermediate portion extending axially from said base portion and terminating at free end thereof, each said finger extending axially past all layers of a coil in said storage volume and said partitioning means additionally includes arcuate extensions between certain of said finger base portions that are axially coextensive with only a portion of said fingers for forming, intermediate certain of said finger sets, continuous channels, said extensions being spaced between two of said finger sets for enabling the flexible hose means to pass between adjacent channels to form adjacent turns of the coil.

* * * * *